US005947216A

United States Patent [19]

Truax et al.

[11] Patent Number: 5,947,216

[45] Date of Patent: Sep. 7, 1999

[54] CUTTER ASSEMBLY FOR ROCK BITS WITH BACK SUPPORT GROOVE

[75] Inventors: David Truax, Houston; Ghanshyam Rai, The Woodlands; Stephen G. Southland, Spring; Gary R. Portwood, Kingwood, all of Tex.

[73] Assignee: Smith International, Inc., Houston, Tex.

[21] Appl. No.: 08/976,913

[22] Filed: Nov. 24, 1997

Related U.S. Application Data

[63] Continuation of application No. 08/668,611, Jun. 18, 1996, abandoned.

[51] Int. Cl.[6] ..... E21B 10/46

[52] U.S. Cl. ..... 175/432

[58] Field of Search ..... 175/432, 428, 175/434, 431, 430

[56] References Cited

U.S. PATENT DOCUMENTS

| | | |
|---|---|---|
| 4,200,159 | 4/1980 | Peschel et al. . |
| 4,382,477 | 5/1983 | Barr . |
| 4,511,006 | 4/1985 | Grainger . |
| 4,660,659 | 4/1987 | Short, Jr. et al. . |
| 4,749,052 | 6/1988 | Dennis . |
| 4,823,893 | 4/1989 | Cantrel . |
| 4,852,671 | 8/1989 | Southland . |
| 4,926,950 | 5/1990 | Zijsling . |
| 4,928,777 | 5/1990 | Shirley-Fisher . |
| 4,972,912 | 11/1990 | Keshavan . |
| 4,993,505 | 2/1991 | Packer et al. . |
| 4,995,887 | 2/1991 | Barr et al. . |
| 5,007,493 | 4/1991 | Coolidge et al. . |
| 5,060,739 | 10/1991 | Griffin . |
| 5,316,095 | 5/1994 | Tibbitts . |
| 5,383,527 | 1/1995 | Azar . |
| 5,460,233 | 10/1995 | Meany et al. . |

FOREIGN PATENT DOCUMENTS

| | | |
|---|---|---|
| 2276645 | 10/1994 | United Kingdom . |

*Primary Examiner*—Hoang C. Dang
*Attorney, Agent, or Firm*—Christie, Parker & Hale, LLP

[57] ABSTRACT

A synthetic diamond cutter is disclosed for rock bits having a diamond cutting face at one end of a body supporting the cutting face. A heel portion is formed by the body near the diamond cutting face. The heel portion forms a groove depression or notch about adjacent to a cutting tip of the diamond cutting face. The cutting tip, as a result of the groove, results in a greater rate of penetration of the diamond cutting face due to a reduction of drag as the cutter works in an earthen formation or against a suitable workpiece.

22 Claims, 2 Drawing Sheets

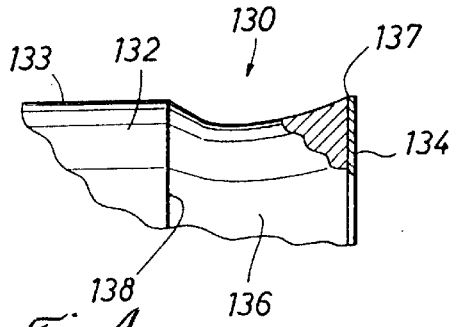
Fig. 4
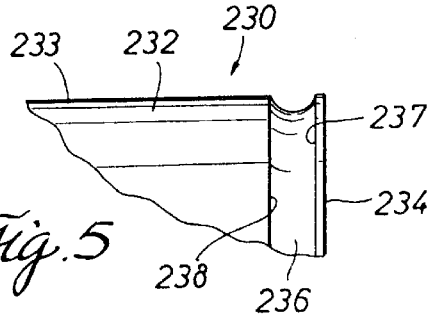
Fig. 5
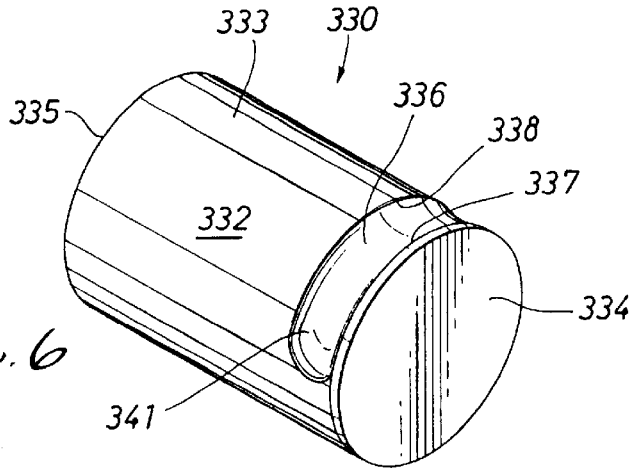
Fig. 6
Fig. 7
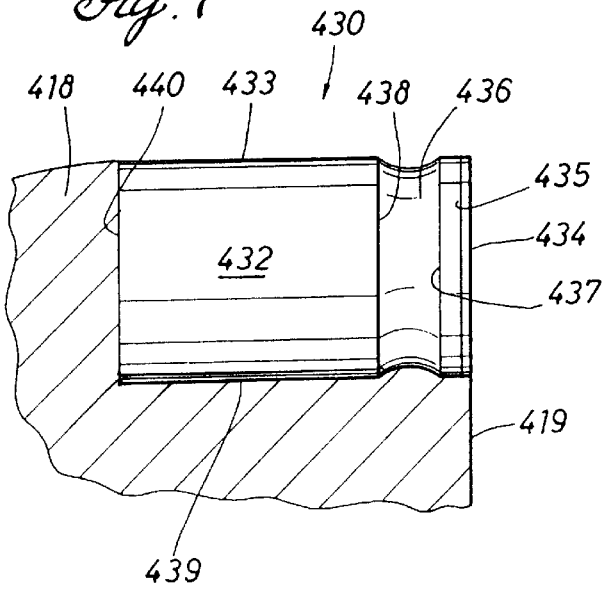
Fig. 8
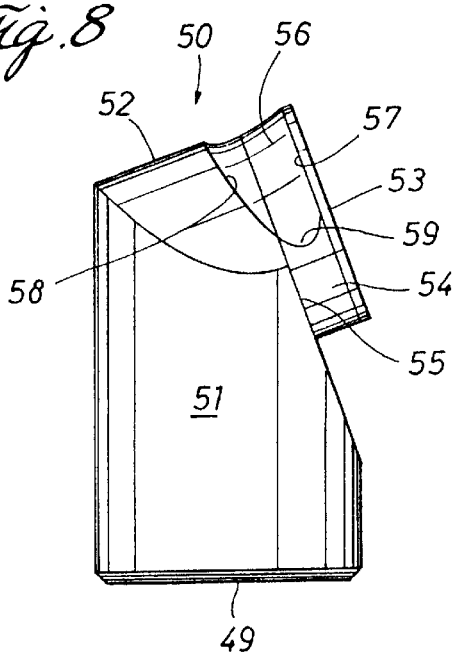

CUTTER ASSEMBLY FOR ROCK BITS WITH BACK SUPPORT GROOVE

This application is a continuation of application Ser. No. 08/668,611 filed Jun. 18, 1996, now abandoned.

BACKGROUND OF THE INVENTION

1. Field of the Invention

This invention relates to super hard inserts for drill bits and their assembly.

More particularly, this invention relates to polycrystalline compact cutter inserts for diamond drag bits. The compact cutters are mounted to diamond bit bodies and a means is provided to maintain each cutter in a sharp condition while performing in an earthen formation.

2. Background

Synthetic cutter inserts consist of a super hard face supported by a stud or cylindrical body usually fabricated from tungsten carbide. The tungsten carbide support substrate has, for example, a diamond layer sintered to the face of the substrate. The substrate is then typically brazed to a stud body. The insert is then pressed into an insert hole formed in the face of a drag bit or a cone of a rotary cone rock bit.

Alternatively, the diamond layer may be sintered directly to a cylindrical body that is subsequently brazed to the cutting face of a drag bit. The diamond layer is composed of a synthetic polycrystalline material. One such manufacturer of the super hard layer is Megadiamond, a division of Smith International, Inc. located in Provo, Utah.

One of the most common type of super hard insert is a polycrystalline diamond compact (PCD) cutter used in diamond drag bits for drilling, which is cylindrical. A cylinder type PCD consists of a right cylinder tungsten carbide body with a thin layer of polycrystalline diamond chemically and metalurgically bonded to an end face of the cylinder using a high pressure/high temperature (HP/HT) sintering process.

Typically, a cylinder type PCD insert cutter is fixedly mounted, by brazing, in a socket formed on the outer surface of a cutter blade fabricated on the drilling face of a drag bit. The PCD insert cutter is, for example, positioned with back rake and heel clearance for the diamond cutting face by tilting the trailing end of the cutter body upward in relation to the borehole bottom.

For drilling many ductile formations, presently utilized PDC cylindrical insert cutters are somewhat inhibited from aggressively cutting the formation by the tungsten carbide substrate immediately behind the layer of diamond. The carbide adjacent the PDC layer, being the same diameter as the sintered diamond, prevents the ultra hard cutter from maximum, penetration of the rock due to the penetration limiting effect of the carbide. Since tungsten carbide is softer than PDC, it will wear faster than the diamond. Experience has shown that, when the carbide wears and exposes the diamond face, the cutter becomes more aggressive.

Therefore, it has been determined that by providing a groove behind the PDC diamond layer nearest the portion of the cutter exposed to the formation, the insert cutter will more aggressively attack the formation resulting in greater rates of penetration.

A number of patents relate to methods and apparatus to relieve stress riser cracks formed at the braze junction between a tungsten carbide substrate supporting a diamond layer and a tungsten carbide stud or cylinder body.

U.S. Pat. No. 4,972,912 and 4,993,505 assigned to the same assignee as the present invention and incorporated by reference, teach methods to inhibit or prevent stress riser cracks at the aforementioned braze juncture.

U.S. Pat. No. 5,060,739 also teaches a means to prevent stress concentrations resulting from brazing a diamond layered disc to a tungsten carbide stud body.

The present invention provides a means to enhance the cutting ability of a super hard cutting face such as PDC layers sintered to a tungsten carbide substrate (studs or cylindrical bodies) for more aggressive performance of the cutter in an earthen formation.

SUMMARY OF THE INVENTION

It is an object of this invention to drill earthen formations at a faster rate with longer bit drilling life than is currently achieved with state of the art drag bits.

More specifically, it is an object of the present invention to modify right cylinder and stud type super hard insert cutters such as PDC cutters by providing a groove adjacent the super hard layer nearest the portion of the cutter exposed to the formation. The groove thus removes the penetration limiting heel portion behind the super hard layer enabling the cutting face to more aggressively cut the formation.

An insert with a super hard cutter face is disclosed with a groove formed in a body of the insert adjacent the cutting face. The groove reduces drag, and increases the cutting rate of the super hard cutter face as the cutter works in a cutting mode.

More specifically, a synthetic diamond insert cutter is disclosed having a diamond cutting face at one end of a body supporting the cutting face. A heel portion is formed by the body near the diamond cutting face. The heel portion forms a groove depression or notch about adjacent to a cutting tip of the diamond cutting face. The cutting tip, as a result of the groove, results in a greater rate of penetration of the diamond cutting face due to a reduction of drag as the cutter works in an earthen formation or against a suitable workpiece.

A circumferential annular groove is, for example, cut into the tungsten carbide behind the PDC diamond layer to provide heel relief for the diamond layer. The groove may only extend partially around the carbide behind the diamond layer only providing relief adjacent the heel closest to the cutting tip of the diamond layer. The groove may be placed adjacent to that portion of the diamond table that gets embedded into the formation.

Moreover, the groove may be abutting the portion of the diamond layer sintered to the carbide substrate or it may be spaced from the diamond layer a short distance without departing from the intent of this invention.

In addition, the partial groove or relieved portion behind the PDC diamond layer may be formed on insert type stud cutters for more efficient cutting action for the stud cutters.

An advantage then of the present invention over the prior art is the use of a relief groove in the heel portion behind a super hard layer such as diamond sintered to a substrate for more aggressive cutting of the diamond insert cutter in an earthen formation.

The above noted objectives and advantages of the present invention will be more fully understood upon a study of the following description in conjunction with the detailed drawings.

BRIEF DESCRIPTION OF THE DRAWINGS

FIG. 4 is a partial cross-section of an alternative right cylinder PDC cutter illustrating a shallow groove immediately behind the diamond layer, the relieved heel portion being elongated axially.

FIG. 5 is side view of a portion of another alternative embodiment whereby the annular groove immediately behind the diamond layer is half round in cross-section.

FIG. 6 is a perspective view of yet another embodiment wherein a partial groove or notch is formed in the heel portion only of the right cylinder diamond cutter, the partial groove being positioned immediately adjacent to the PDC cutting face.

FIG. 7 is a side view of another alternative embodiment of a right cylinder diamond cutter wherein the annular groove or notch is formed in the tungsten carbide, the groove being axially spaced from the diamond layer sintered to the tungsten carbide substrate.

FIG. 8 is a side view of a stud type insert designed to be pressed or interference fitted within insert sockets formed in a cutting face of a drill bit, a partial groove being formed in the heel portion of the insert.

DESCRIPTION OF THE PREFERRED EMBODIMENTS AND BEST MODE FOR CARRYING OUT THE INVENTION

Figure 1:
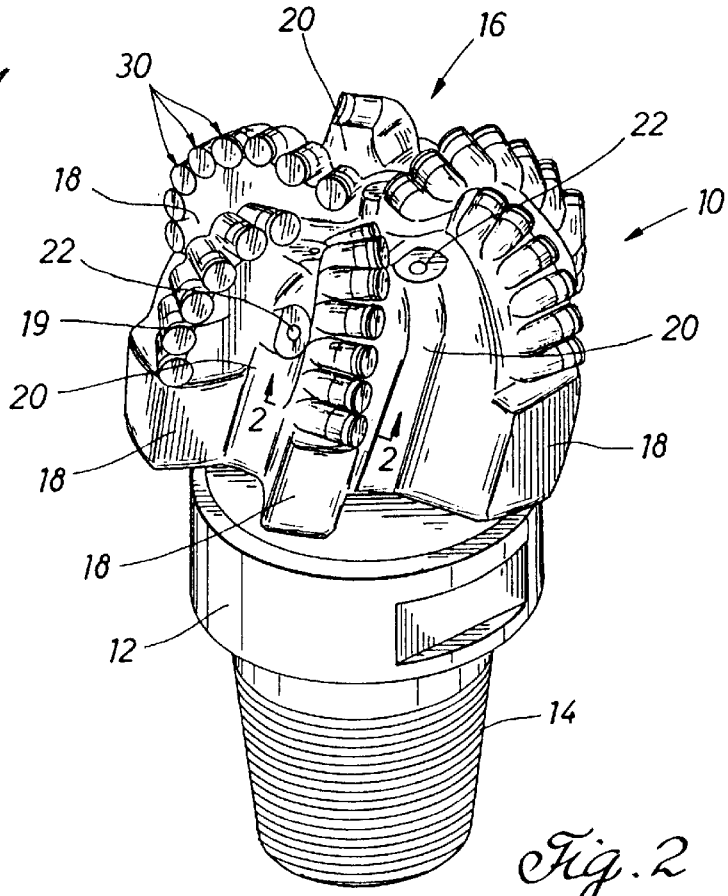
FIG. 1 is a perspective view of a diamond drag bit.

FIG. 1 illustrates a diamond drag bit generally designated as 10. The bit consists of a bit body 12 forming an open threaded pin end 14 and an opposite cutting end generally designated as 16. Cutting end 16 is comprised of a multiplicity of essentially radial raised lands or blades 18 with fluid channels 20 formed therebetween. A number of fluid nozzles 22 are strategically positioned on the cutting end 16 to supply high velocity drilling fluid to channels 20 to cool and clean the diamond cutters generally designated as 30 secured within blades 18.

The plurality of super hard inserts such as polycrystalline diamond compact cutters 30 are disposed strategically in the outer surface of the raised blades 18 and where appropriate, around the periphery of the bit 10 (not shown).

As the bit rotates on the bottom of a borehole (not shown), the diamond cutters 30 engage the rock formation with a shearing action to destroy the rock. The drilled rock cuttings are then entrained in the high velocity fluid to exit the borehole (again, not shown).

Figure 2:
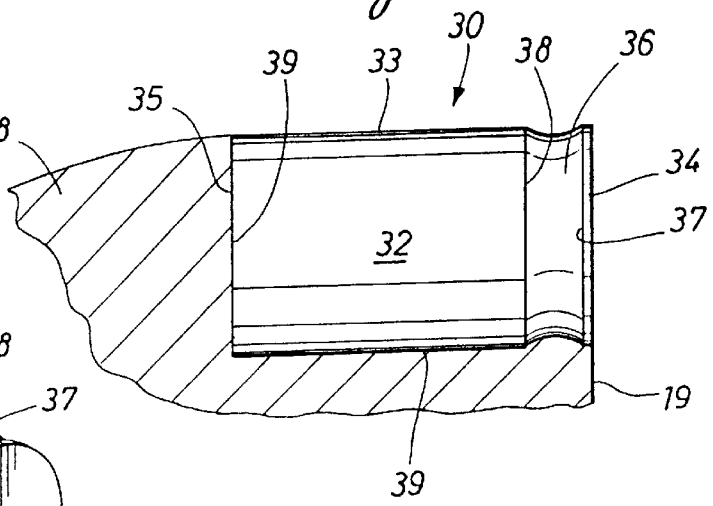
FIG. 2 is a view taken through 2—2 of FIG. 1.

Turning now to FIG. 2, the right cylinder PDC cutter generally designated as 30 consists of a diamond layer 34 sintered to a cylindrical body 32. A relatively shallow groove or notch 36 is for example, annularly formed around the cutter 30, a leading edge 37 abutting the base of the PDC layer 34. A trailing edge 38 extends axially rearwardly a sufficient distance to form a depression or groove in the body 32. The cutter is secured, usually by brazing in a blade 18 that is typically fabricated from a cast metal powder matrix or a machined steel cutter head. The exposed heel portion 33 of the right cylinder cutter 30 is thus provided with a groove 36 behind the diamond cutting layer 34 thereby assuring that the cutter stays sharp and aggressive while the bit 10 works in a borehole.

Obviously the plurality of right cylinder cutters 30 are strategically oriented in the face 19 of blade 18 of the bit 10.

Figure 3:
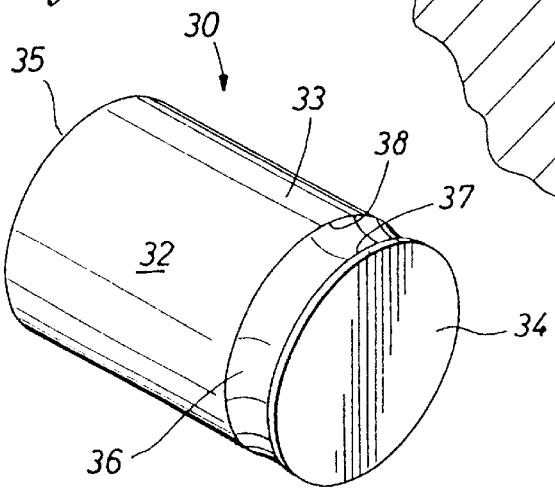
FIG. 3 is a perspective view of a right cylinder PDC cutter illustrating an annular groove or notch positioned adjacent the diamond layer.

FIG. 3 illustrates the cutter 30 prior to securing the cutter to the cutting face of the drag bit 10. The groove 36 being formed entirely around the cylinder body 32. As previously stated, the leading edge of the groove or notch 37 abuts the PDC layer for maximum cutting effectiveness.

The partial cross-section of FIG. 4 shows an elongated asymmetrical groove or notch 136 immediately behind the PDC layer 134 formed in an alternative embodiment diamond cutter 130. The modified, relatively shallow groove 136 (wherein the trailing edge 138 is spaced axially further from the leading edge 137) may be advantages from a stress riser reduction viewpoint. The insert 130 would be more robust in harder rock formations.

FIG. 5 illustrates another alternative embodiment wherein the PDC cutter 230 has a half round annular groove 236 with a leading edge 237 immediately adjacent the diamond layer. This configuration would be very aggressive and more suitable for softer formations.

FIG. 6 is yet another alternative embodiment wherein the cylindrical diamond cutter 330 has a groove or notch 336 formed only in the heel portion 333 of the body 332. The groove or notch 336 may be from 180 degrees to 60 degrees of a circumference of the exposed heel portion 333 of the cylindrical PDC cutter 330. The ends 341 of the partial groove 336 may be exposed or imbedded within the socket formed within cutter head 16 (FIG. 1) as long as the groove is in the exposed heel portion 333 of the right cylinder cutter 330.

FIG. 7 shows the groove 436 spaced from the PDC layer 434 in cylindrical body 432 of alternative cutter 430. The leading edge 437 of the groove or notch 436 is formed in the tungsten carbide body 432 a short distance behind the sintered base 435 of the PDC layer 434. The diamond cutting edge will be aggressive even though the groove 436 is spaced axially, a relatively short distance, from the diamond layer 436 without departing from the scope of the invention.

Moreover, the groove or notch may only be partially formed around the various heel portions of the preferred and alternative cylindrical diamond cutters (as depicted in FIGS. 6 and 8) without departing from the intent of this invention.

The stud cutter illustrated in FIG. 8 and generally designated as 50 would also benefit from the partial groove 56 in heel portion 52 of stud body 51. The leading edge 57 is, for example, positioned adjacent to the base of the PDC layer 53 sintered to the tungsten carbide substrate 54. The substrate 54 being brazed to the stud body 51 at interface 55. The trailing edge 58 of the partial groove or notch 56 may be behind the braze joint interface 55 and the ends 59 of the groove 56 may be positioned from 60 to 180 degrees through the heel portion 52 to effect a sharp cutting edge of the PDC layer of the stud cutter 50 as it works in a borehole.

It would be obvious to fabricate the grooved or notched cutter inserts with a super hard cutting face formulated from a material other than diamond without departing from the spirit of this invention.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A drill bit comprising a synthetic diamond cutter comprising:

a stud body having a first end mounted in the bit and a heel portion defined at a second end;

a cylindrical body having a first end interfacing with the stud body and a second end opposite the first end, wherein a portion of the outer surface of the cylindrical body is aligned with an outer surface of the heel portion;

a diamond cutter face formed at the second end of the cylindrical body;

an exposed groove depression formed entirely in the heel portion and extending on the cylindrical body, the groove having a surface having a leading edge adjacent to the diamond cutter face, and a trailing edge on the heel portion.

2. A drill bit as recited in claim 1 wherein the groove has a leading edge abutting the diamond cutter face.

3. A drill bit as recited in claim 1 wherein the groove is asymmetrical in cross-section.

4. A drill bit as recited in claim 1 wherein the groove spans a portion of about 60° to 180° of the heel and cylindrical body.

5. A drill bit comprising a cutter, the cutter comprising:

a right circular cylindrical body having a radius having a length and having a cylindrical outer surface, a first end interfacing with the bit and an end face opposite the first end;

an ultra hard material layer on the end face, the layer having a circumferential edge, wherein a portion of the circumferential edge is used to cut during drilling; and an exposed recess formed on the cylindrical surface adjacent to said portion of the circumferential edge, wherein the recess is formed on less than the entire length of the cylindrical body, wherein the recess has a maximum depth penetrating radially inward into the cylindrical body not greater than the length of the radius, and wherein a majority of the recess is concave in cross-section.

6. A drill bit as recited in claim 5 wherein the recess is spaced apart from the ultra hard material layer.

7. A drill bit as recited in claim 5, wherein the recess has a non-symmetric cross-section.

8. A drill bit comprising a cutter, the cutter comprising:

a right circular cylindrical body having a cylindrical outer surface, a first end interfacing with the bit, a central axis, an end face opposite the first end, and a radius having a length;

an ultra hard material layer on the end face, the layer having a circumferential edge, wherein a portion of the circumferential edge is used to cut during drilling; and an exposed recess formed entirely in the cylindrical body and having a trailing edge terminated at the cylindrical surface spaced apart from the first end, said recess being adjacent to said portion of the circumferential edge of the ultra hard material layer, wherein the recess cross-section along a plane running along the central axis is concave, and wherein the recess has a maximum depth penetrating radially inward into the cylindrical body not greater than the length of the radius.

9. A drill bit as recited in claim 8 wherein the recess is spaced apart from the ultra hard material layer.

10. A drill bit as recited in claim 8 wherein the recess has a non-symmetric cross-section.

11. A drill bit as recited in claim 8 wherein the recess spans only a portion of the cylindrical surface circumference.

12. A stud cutter comprising:

a stud body;

a right circular cylindrical body having a cylindrical outer surface and an end face, the cylindrical body attached to the stud body;

an ultra hard material layer on the end face, the layer having a circumferential edge, wherein a portion of the circumferential edge is used to cut during drilling;

an exposed circumferential recess formed on the cylindrical surface adjacent to said portion of the circumferential edge of the ultra hard material layer, wherein said recess does not extend to the stud body and does not penetrate through the entire cylindrical body and does not penetrate through the entire cylindrical body.

13. A stud cutter as recited in claim 12 wherein the recess extends around a portion of the cylindrical body circumference.

14. A stud cutter as recited in claim 12 wherein the recess formed on the cylindrical outer surface extends onto the stud body.

15. A stud cutter as recited in claim 14 wherein the recess has a non-symmetric cross-section.

16. A stud cutter as recited in claim 14 wherein the recess has a width that varies circumferentially.

17. A stud cutter as recited in claim 16 wherein the cutter has a heel surface for contacting earth formations, the heel surface comprising a portion of a surface of the stud body and a portion of the cylindrical surface, wherein the recess has a maximum width along the heel surface.

18. A stud cutter as recited in claim 17 wherein the recess has a non-symmetric cross-section.

19. A cutter comprising:

a right circular cylindrical body having a cylindrical outer surface, a first end and an end face opposite the first end;

an ultra hard material layer on the end face, the layer having a circumferential edge, wherein a portion of the circumferential edge is used to cut during drilling; and a concave indentation formed on the cylindrical surface beginning adjacent to said portion of the circumferential edge of the ultra hard material layer and ending on the cylindrical outer surface.

20. A cutter comprising:

a right circular cylindrical body having a cylindrical outer surface, a first end and an end face opposite the first end;

an ultra hard material layer on the end face, the layer having a circumferential edge, wherein a portion of the circumferential edge is used to cut during drilling; and a recessed surface formed on the cylindrical body adjacent to said portion of the circumferential edge of the ultra hard material layer, wherein the recess surface comprises a leading edge spaced apart from the ultra hard material layer, and a trailing edge terminating at the cylindrical outer surface and wherein the recessed surface does not venetrate through the entire cylindrical body.

21. A drill bit comprising a cutter, the cutter comprising:

a right circular cylindrical body having a cylindrical outer surface and an end face;

an ultra hard material layer on the end face; and an exposed indentation formed on the cylindrical surface, the indentation having a leading edge abutting the ultra hard material layer, wherein the indentation is formed on less than the entire length of the cylindrical body and wherein a majority of the indentation is concave in cross-section.

22. A drill bit comprising a cutter, the cutter comprising:

a right circular cylindrical body having a cylindrical outer surface and an end face;

an ultra hard material layer on the end face; and an exposed recess formed on the cylindrical surface, the recess having a leading edge abutting the ultra hard material layer, a trailing edge intersecting the cylindrical outer surface, and a continuous surface between the leading and trailing edges.

* * * * *

UNITED STATES PATENT AND TRADEMARK OFFICE

CERTIFICATE OF CORRECTION

PATENT NO. : 5,947,216
DATED : September 7, 1999
INVENTOR(S) : David Truax; Ghanshyam Rai; Stephen G. Southland; Gary R. Portwood It is certified that error appears in the above-identified patent and that said Letters Patent is hereby corrected as shown below:

Column 1,
Line 66, replace "U.S. Pat. No." with -- U.S. Pat. Nos. --.

Column 3,
Line 8, after "FIG. 5 is" insert -- a --.

Column 4,
Line 9, replace "advantages" with -- advantageous --.
Line 43, replace "substrate 54. The" with -- substrate 54, the --.

Column 6,
Lines 8-9, after "cylindrical body" delete "and does not penetrate through the entire cylindrical body" (second occurrence).
Line 53, replace "venetrate" with -- penetrate --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*